US006048413A

United States Patent [19]

Park et al.

[11] Patent Number: 6,048,413

[45] Date of Patent: Apr. 11, 2000

[54] DUPLEX STAINLESS STEEL WITH HIGH CORROSION RESISTANCE

[76] Inventors: Yong Soo Park, Joongang Heights Villa 532, 1000-3, Bangbae-Dong, Seocho-Ku, Seoul; Young Sik Kim, Hyundai Apt. 205-901, 600, Yongsang-Dong, Andong, Kyungsangbook-do, both of Rep. of Korea

[21] Appl. No.: 08/819,176

[22] Filed: Apr. 28, 1997

Related U.S. Application Data

[63] Continuation of application No. 08/444,338, May 18, 1995, abandoned.

[30] Foreign Application Priority Data

May 21, 1994 [KR] Rep. of Korea ..... 94-11132

[51] Int. Cl.[7] ..... C22C 38/44

[52] U.S. Cl. ..... 148/325; 148/327; 420/67; 420/68

[58] Field of Search ..... 148/325, 327; 420/67, 68, 69

[56] References Cited

U.S. PATENT DOCUMENTS 4,915,752 4/1990 Culling ..... 148/325

5,238,508 8/1993 Yoshitake et al. ..... 148/325

5,298,093 3/1994 Okamoto ..... 148/325

FOREIGN PATENT DOCUMENTS 0 757 112 A1 2/1997 European Pat. Off. .

*Primary Examiner*—Deborah Yee

*Attorney, Agent, or Firm*—Townsend and Townsend and Crew LLP

[57] ABSTRACT

A corrosion resistant duplex stainless steel having an austenite-ferrite duplex phase matrix, less content of the expensive nickel and higher the resistance to both stress corrosion cracking and pitting in environments containing chloride ion is disclosed. The stainless steel is also scarcely influenced by the aging heat treatment. This stainless steel includes 20–30 wt % chromium, 3–9 wt % nickel, 3–8 wt % molybdenum, 0.20 wt % or less carbon, 0.5–2.0% silicon, 3.5 wt % or less manganese, 0.2–0.5% nitrogen and a balance of iron. The stainless steel may include at least one element selected from the group of 1.5 wt % or less titanium, 3 wt % or less tungsten, 2 wt % or less copper, and 2 wt % or less vanadium and include at least one element selected from the group of 0.001–0.01 wt % boron, 0.001–0.1 wt % magnesium, 0.001–0.1 wt % calcium, and 0.001–0.2 wt % aluminum.

4 Claims, 9 Drawing Sheets

DUPLEX STAINLESS STEEL WITH HIGH CORROSION RESISTANCE

This is a Continuation of application Ser. No. 08/444,388, filed May 18, 1995 now abandoned, the disclosure of which is incorporated by reference.

BACKGROUND OF THE INVENTION

1. Field of the Invention

The present invention relates in general to duplex phase stainless steels having austenite-ferrite duplex phase matrix and good resistance to both stress corrosion cracking and pitting, and suitable for use in the areas of heat exchangers using seawater as cooling water, tanks and pipes of desalination plants, FGD (Flue Gas Desulfurization) equipments fossil power plants, tubes and pipes of refineries and petrochemical plants, equipments of chemical plants and waste water disposal plants.

2. Description of the Prior art

It has been typically noted that stainless steels are special steels having excellent corrosion resistance in comparison with the other alloy steels. However, typical commercial stainless steels have no good resistance against both stress corrosion cracking (SCC) and crevice corrosion, such as pitting, so that the typical stainless steels can not be used as materials of equipments for the environments including high concentration of chloride ion. In this regard, titanium alloy or nickel-based super alloy instead of the typical stainless steels are used as the material of equipments for the environments including high concentration of chloride ion.

However, the titanium alloy and the nickel-based super alloy are not only limited in their production amounts but also very expensive in comparison with the typical stainless steels. In this regard, there have been continuous studies on the development of improved corrosion resistant stainless steel by controlling composition of alloy elements of the stainless steel.

For example, both AISI 316 (Sammi Specialty Steel Co. Ltd., Korea) produced by addition of 2–3% of Mo to austenitic stainless steel of AISI 304 and the austenitic stainless steel such as nitrogen-laden AISI 317 LNM (Creusot-Loire Industrie, France) being noted to have somewhat improved the corrosion resistance of the stainless steel. However, those stainless steels are also noted to have poor resistance against SCC in specified corrosion environments, such as chloride ion-containing solution under tensile stress. In an effort to overcome the problems of those stainless steels, duplex phase stainless steel having austenite-ferrite duplex phase matrix has been proposed.

However, the corrosion resistance of the duplex phase stainless steel will be reduced in the case of aging heat treatment of the stainless steel. In this regard, the corrosion resistance of the stainless steel goods can not help being reduced when the steel is heated such as by welding. Such reduction of corrosion resistance of the typical corrosion resistant stainless steel due to the aging heat treatment is caused by transformation of the ferrite phase of the duplex phase stainless steel into austenite II phase and sigma phase including large amount of chromium and molybdenum and having high hardness.

U.S. Pat. No. 4,500,351 discloses a cast duplex phase stainless steel which generates no pitting in anode polarization at temperatures of 50° C.–78° C. in 1 mole NaCl solution but generates crevice corrosion at 47.5° C. in 10% $FeCl_3.6H_2O$.

SUMMARY OF THE INVENTION

It is, therefore, an object of the present invention to provide a corrosion resistant duplex phase stainless steel which has an austenite-ferrite duplex phase matrix, and which has reduced content of the expensive nickel and improved resistance to both stress corrosion cracking and pitting in chloride ion-containing environment.

It is another object of the present invention to provide a corrosion resistant duplex phase stainless steel which is scarcely influenced by the aging heat treatment but has improved resistance to both stress corrosion cracking and pitting.

In order to accomplish the above object, the present invention provides a corrosion resistant duplex phase stainless steel comprising 20–30 wt % chromium, 3–9 wt % nickel, 3–8 wt % molybdenum, 0.20 wt % or less carbon, 0.5–2.0% silicon, 3.5 wt % or less manganese, 0.2–0.5% nitrogen and a balance of iron.

The stainless steel may include at least one element selected from the group of 1.5 wt % or less titanium, 3 wt % or less tungsten, 2 wt % or less copper, and 2 wt % or less vanadium.

The stainless steel may include at least one element selected from the group of 0.001–0.01 wt % boron, 0.001–0.1 wt % magnesium, 0.001–0.1 wt % calcium, and 0.001–0.2 wt % aluminum.

BRIEF DESCRIPTION OF THE DRAWING

The above and other objects, features and other advantages of the present invention will be more clearly understood from the following detailed description taken in conjunction with the accompanying drawings, in which:

(FIG. 2A: samples 7, 8 and 9; FIG. 2B: samples 10, 11 and 12) of this invention and AISI 304 stainless steel in the boiling solution of 42% $MgCl_2$;

DESCRIPTION OF THE PREFERRED EMBODIMENTS

Figure 1:
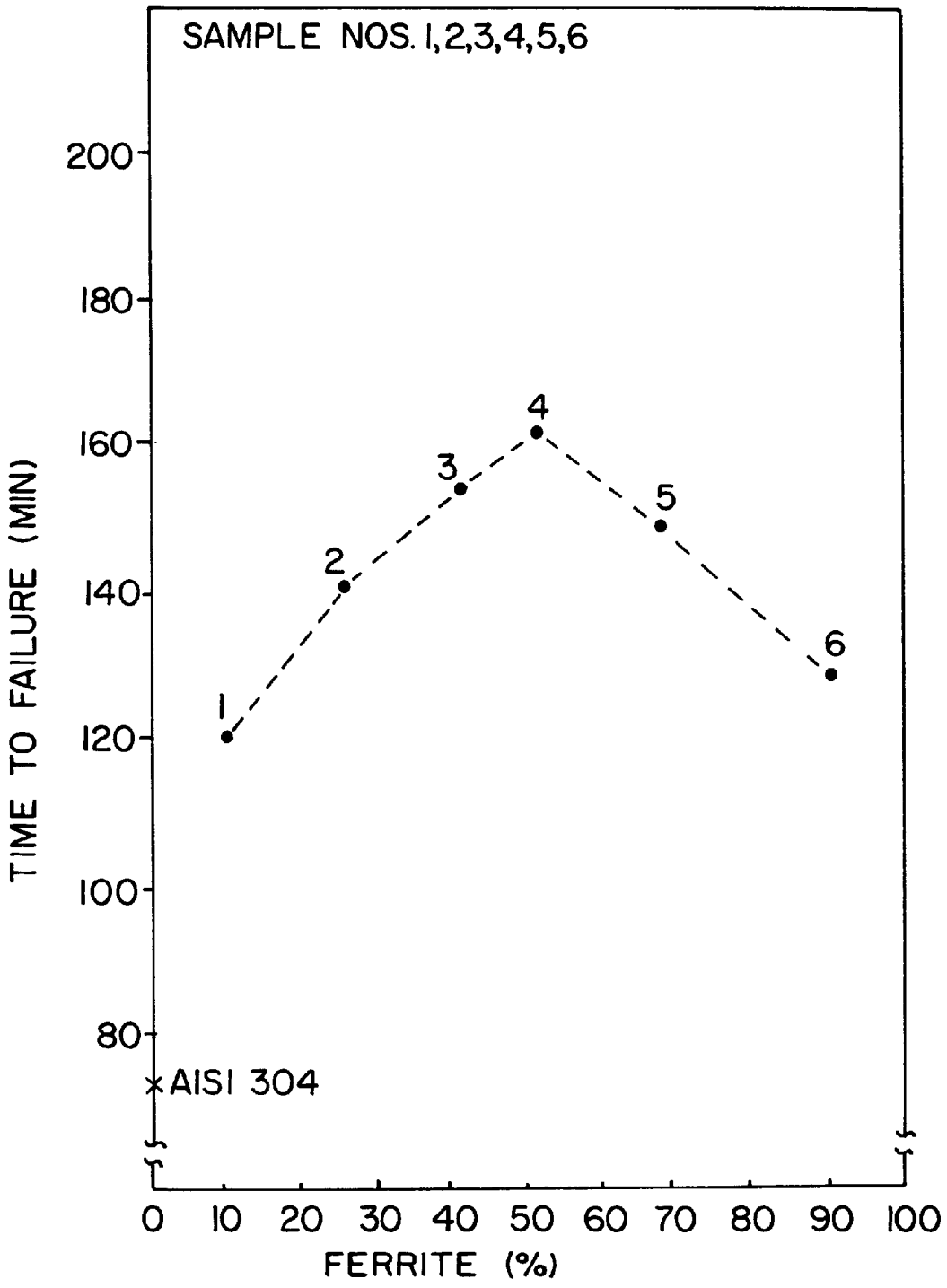
FIG. 1 is a graph showing the results of stress corrosion cracking test of alloy samples of this invention in a boiling solution of 42% $MgCl_2$ in accordance with variation of ferrite contents of the alloy samples.

The duplex phase stainless steel of the present invention includes 20–30 wt % chromium, 3–9 wt % nickel, 3–8 wt % molybdenum, 0.20 wt % or less carbon, 0.5–2.0% silicon, 3.5 wt % or less manganese, 0.2–0.5% nitrogen and a balance of iron.

In order to not only reduce the influence of aging heat treatment but also improve the corrosion resistance of the resulting stainless steel, further the stainless steel may be added with at least one element selected from the group of 1.5 wt % or less titanium, 3 wt % or less tungsten, 2 wt % or less copper, and 2 wt % or less vanadium.

In order to improve hot workability, the stainless steel may be added with at least one element selected from the group of 0.001–0.01 wt % boron, 0.001–0.1 wt % magnesium, 0.001–0.1 wt % calcium, and 0.001–0.2 wt % aluminum.

When comparing the instant corrosion resistant duplex phase stainless steel with the typical stainless steels, the instant stainless steel has a relatively higher critical pitting temperature of about 95–90° C. in 10% $FeCl_3.6H_2O$ solution. In addition, the instant stainless steel not only has a high passive region not less than 1000 mV but also scarcely generates pitting in an anodic polarization, thus to have improved corrosion resistance and to substitute for expensive titanium alloy or expensive nickel-based super alloy.

The instant stainless steel has shown scarcely increase in the corrosion rate after aging heat treatment so that the stainless steel has an advantage that it is scarcely influenced by the aging heat treatment. The reason why the instant stainless steel is scarcely influenced by the aging heat treatment is judged to be resulted from appropriate control of austenite-ferrite phase ratio. In the case of addition of titanium to the stainless steel, titanium compound is formed in the steel as a result of the aging heat treatment and the titanium compound retards transformation of ferrite into sigma+austenite II. Such retardation of transformation is also judged to cause the instant stainless steel to be scarcely influenced by the aging heat treatment.

In the present invention, the stainless steel has the highest corrosion resistance when its ferrite content is about 40–50 wt %. The reason why the stainless steel has the highest corrosion resistance in the case of the ferrite content of about 40–50 wt % is that the mechanically hard ferrite phase under low or middle stress acts as an obstacle in inducing slip. The ferrite phase also electrochemically acts as the anode for the austenite phase in the chloride environment so that the austenite phase becomes the cathode. Such an austenite phase retards cracking during dissolution of ferrite phase. In a given plastic model, the austenite phase has a stress component smaller than that of the ferrite phase but has a high thermal expansion coefficient at a high temperature so that the austenite phase is more easily shrunk than the ferrite phase in the case of cooling. In this regard, a compressive residual stress is generated in the outside of the interface between the phases and limits possible cracking so that the phases in the matrix limit cracking propagation. Therefore, the ferrite of about 50 wt % results in the highest corrosion resistance of the stainless steel.

The elements of the duplex phase stainless steel of this invention have their intrinsic functions and are preferably limited in their contents due to the following reasons.

Chromium

Chromium (Cr) is an element for ferrite stabilization and acts as one of important elements for corrosion resistance of the resulting alloy. In order to form the austenite-ferrite duplex phase matrix in the alloy (stainless steel) of this invention, at least 20 wt % chromium should be included in the alloy in consideration of balance of carbon, nitrogen, nickel, molybdenum, silicon and manganese. However, when considering the phase ratio of the austenite-ferrite duplex phases, mechanical characteristic and cost of resulting stainless steel, it is not preferred to add 30 wt % or more chromium to the alloy.

Nickel

Nickel (Ni) is a strong element for austenite stabilization and a profitable element for corrosion resistance of the resulting alloy so that at least 3 wt % nickel is preferably included in the alloy. In order to not only keep the desired phase ratio of the austenite-ferrite in accordance with balance of the other elements but also reduce the cost of the resulting alloy, the content of nickel is limited to 9 wt % and more preferably ranged from 4 to 8 wt %.

Molybdenum

Molybdenum (Mo) is an element for ferrite stabilization and acts as one of important elements for corrosion resistance of the resulting alloy. It is preferred to limit the content of molybdenum to 8 wt % in view of workability and phase stability during heat treatment. More preferably, the content of molybdenum is ranged from 4.5 to 7 wt %.

Carbon

Carbon (C) is one of important elements for mechanical variable as it is a strong element for austenite stabilization. However, as the carbon will reduce both corrosion resistance and hot workability, it is preferred to limit the content of carbon up to 0.20 wt %. It is more preferable to limit the content of carbon up to 0.03 wt % in view of corrosion resistance of the resulting alloy.

Silicon

Silicon (Si) is an element for ferrite stabilization and gives a deoxidation effect during the melting and acts as an element for improving oxidation resistance of the resulting alloy. However, excessive silicon will reduce both toughness and ductility of the resulting alloy so that the content of silicon is preferably ranged from 0.5 to 2.0 wt %. In addition, it is also preferred to limit the content of silicon up to 1.0 wt % in view of corrosion resistance of the resulting alloy.

Nitrogen

Nitrogen (N) is a strong element for austenite stabilization and acts as one of important elements for corrosion resistance of the resulting alloy. When the nitrogen is included along with molybdenum in the alloy, the effect of nitrogen is more enhanced due to improvement of passive layer characteristic. When reducing the content of carbon in the resulting alloy in order for improving the intergranular corrosion resistance, it is possible to compensate for reduced mechanical performance of the alloy by addition of nitrogen. The content of nitrogen is preferably limited up to 0.5 wt % in view of both balance of the other elements and desired phase ratio of austenite-ferrite. In addition, it is also preferred to let the content of nitrogen not less than 0.15 wt % in view of corrosion resistance of the resulting alloy.

Copper

Copper is an element for austenite stabilization and strengthens the matrix of the resulting alloy and increases the strength of the resulting alloy. However, excessive copper will reduce corrosion resistance of the resulting alloy. In sulfuric acids, Cu increases corrosion resistance. It is prefered to have Cu under 2 wt %.

Titanium

Titanium is an element having deoxidation effect during the melting and may be added to the alloy in order for improving the intergranular corrosion resistance. When adding the titanium for resistance against intergranular corrosion, it is required to consider relation of the titanium with the amount of added carbon. The content of Ti is preferably ranged from 0.5 to 1.5 wt % to increase the corrosion resistance in environments containing chloride after the aging heat treatment.

Each alloy sample of the present invention is produced as follows.

After making prediction about intended ferrite content by calculating both chromium equivalent and nickel equivalent considering influence of nitrogen, the gradients of commercially pure grade electrolytic iron (99.9% purity), chromium (99.6% purity), molybdenum (99.8% purity), nickel (99.9% purity), Fe—Si and Fe—Cr–N are melted in a magnesia crucible of a high frequency induction furnace under gaseous nitrogen ambient and, thereafter, formed into an ingot using a sufficiently preheated metal mold or sand mold.

The chromium equivalent ($Cr_{eq}$) and the nickel equivalent ($Ni_{eq}$) are calculated by the following equations 1 and 2 respectively.

$$Cr_{eq}=\%Cr+1.5\%Si+\%\ Mo+\%\ Cb-4.99 \quad (1)$$

$$Ni_{eq}=\%Ni+30\%C+0.5\%Mn+26(\%\ N-0.02)+2.77 \quad (2)$$

For the production of wrought material, the ingot is machined into an appropriate size by machining or grinding and, thereafter, subjected to soaking at a temperature of 1050–1250° C. and for a soaking time of at least 1 hr/inch. After the soaking, the ingot is subjected to the hot rolling and cooled in water. As there may be a chance of cracking in the hot plate due to precipitation of sigma phase in the case of lower finishing temperature of the hot rolling, the finishing temperature of the hot rolling should be kept at at least 1000° C. In order to remove oxides formed on the hot plate as a result of the hot rolling, the ingot is rolled to 1–2 mm thickness through cold rolling after pickling in a solution of 10% $HNO_3$+3% HF at a temperature of 66° C.

In order to let castings, hot-rolled products or cold-rolled products of the stainless steel of the invention have optimal performance, it is preferred to subject the products to annealing for 1–2 min/mm (thickness) at temperature of 1100–1150° C. in accordance with compositions of alloy. After the annealing, the products are again subjected to pickling in a solution of 10% $HNO_3$+3% HF at temperature of 66° C. so as to remove oxide scales from the products.

Test for the stress corrosion cracking (SCC) resistance of the instant stainless steel was carried out by the SCC test of constant extension rate test proposed by standard G 36–75 of ASTM (American Society for Testing and Materials). That is, the resulting alloy samples of the invention were immersed in a corrosion cell containing 42% $MgCl_2$ at a constant temperature of 154° C. and the fracture times of the samples in the corrosion cell were measured. In this case, the longer fracture time of an alloy sample, the higher SCC resistance the alloy sample has.

The resistance against pitting corrosion of the alloy samples of this invention was measured by both weight loss test and anodic polarization test.

The weight loss test for the instant alloy samples was carried out through a method proposed by ASTM G48 or its adherent method. For example, the pitting corrosion rate of the alloy samples was measured from the weight loss rate of the samples by immersing the samples in a solution of 10 wt % $FeCl_3.6H_2O$ for 24 hours at a constant temperature of 50° C. In the weight loss test, the less weight loss of an alloy sample, the higher pitting corrosion resistance the alloy sample has.

In the anodic polarization test of the alloy samples for testing the pitting corrosion, 0.5N HCl+1N NaCl solution or 22% NaCl solution was used as the test solution. A potential-current curve was obtained while scanning, using potentiostat, the potential from corrosion potential to more anodic potential and, thereafter, the pitting corrosion resistance of the alloy was measured from the critical current density, passive current density and pitting potential. The pitting corrosion resistance of the alloy is in inverse proportion to both the critical current density and the passive current density. In addition, the pitting corrosion resistance is in proportion to the pitting potential and this means that the pitting corrosion resistance is increased when the curve moves leftward.

A better understanding of the present invention may be obtained by looking at the following examples which are set forth to illustrate, and are not to be construed to limit, the present invention.

EXAMPLE I

With substance of electrolytic iron, chromium, nickel, molybdenum, Fe—Si, Fe—Cr—N, all commercially adoptable quality grade, 12 kg of each of alloy specimens was prepared according to the compositions as indicated in Table 1, under a nitrogen environments in a high frequency induction furnace. At the moment parts which contains pores were detected by radiographic method, and were removed.

After the resulting ingots were subjected to soaking at 1,150° C. for 30 min., they were hot rolled into a thickness of 3 mm at a finishing temperature of 1,100° C. Scale which was produced on the surface owing to the hot rolling was removed by pickling them in a mixture solution of nitric acid and hydrofluoric acid with a temperature of 66° C. maintained. Thereafter, they were cold rolled into a thickness of 1 mm, annealed at a temperature of 1,100 to 1,150° C. for 5 min. and cooled in water. Likewise, the scale produced on the surface due to annealing was removed.

TABLE 1

Chemical Compositions in the Present and Reference Alloys
Unit: wt %

| Alloy No. | C | Ni | Cr | Mo | Si | Mn | N | Others |
|---|---|---|---|---|---|---|---|---|
| 1 | 0.02 | 11.62 | 20.56 | 6.75 | 0.97 | — | 0.29 | |
| 2 | 0.03 | 7.65 | 20.82 | 6.94 | 0.95 | — | 0.28 | |
| 3 | 0.02 | 6.60 | 21.96 | 6.59 | 1.14 | — | 0.29 | |
| 4 | 0.02 | 5.03 | 20.92 | 6.84 | 0.99 | — | 0.28 | |
| 5 | 0.02 | 4.27 | 21.36 | 6.52 | 1.09 | — | 0.27 | |

TABLE 1-continued

Chemical Compositions in the Present and Reference Alloys
Unit: wt %

| Alloy No. | C | Ni | Cr | Mo | Si | Mn | N | Others |
|---|---|---|---|---|---|---|---|---|
| 6 | 0.03 | 2.15 | 20.61 | 6.83 | 0.96 | — | 0.26 | |
| 7 | 0.02 | 9.11 | 21.66 | 6.90 | 0.76 | — | 0.32 | |
| 8 | 0.01 | 8.12 | 21.80 | 6.76 | 0.79 | — | 0.29 | |
| 9 | 0.01 | 6.05 | 21.96 | 6.55 | 0.69 | — | 0.28 | |
| 10 | 0.15 | 7.68 | 21.91 | 6.47 | 0.86 | — | 0.29 | |
| 11 | 0.15 | 6.81 | 21.88 | 6.41 | 0.93 | — | 0.29 | |
| 12 | 0.16 | 5.81 | 21.89 | 6.55 | 0.88 | — | 0.32 | |
| 13 | 0.02 | 7.17 | 23.33 | 6.85 | 0.51 | 0.32 | 0.35 | |
| 14 | 0.03 | 5.25 | 23.63 | 2.84 | 0.52 | 0.38 | 0.37 | |
| 15 | 0.12 | 7.28 | 23.43 | 6.80 | 0.59 | 1.06 | 0.32 | Ti 0.25 |
| 16 | 0.04 | 7.40 | 23.54 | 6.83 | 0.56 | 1.13 | 0.39 | Cu 0.84 |
| 17 | 0.13 | 7.36 | 23.61 | 6.75 | 0.57 | 1.12 | 0.33 | |
| 18 | 0.09 | 5.52 | 21.15 | 6.01 | 0.72 | 1.02 | 0.35 | |
| 19 | 0.02 | 6.34 | 21.12 | 5.95 | 0.61 | 1.01 | 0.35 | |
| 20 | 0.10 | 2.21 | 22.31 | 6.14 | 1.12 | 1.03 | 0.34 | |
| 21 | 0.09 | 11.12 | 20.93 | 6.05 | 1.34 | 0.51 | 0.33 | |
| 22 | 0.12 | 6.53 | 20.27 | 5.69 | 1.26 | 0.56 | 0.32 | |
| 23 | 0.15 | 6.23 | 21.92 | 5.52 | 1.26 | 0.65 | 0.25 | Ti 0.48 |
| 24 | 0.16 | 6.59 | 21.40 | 5.61 | 1.34 | 0.65 | 0.25 | Ti 0.43 |
| 25 | 0.03 | 4.01 | 21.36 | 6.52 | 1.21 | 0.56 | 0.29 | |
| 26 | 0.02 | 3.99 | 21.42 | 6.30 | 1.25 | 0.70 | 0.31 | |
| 27 | 0.03 | 4.19 | 21.45 | 6.27 | 1.21 | 0.64 | 0.28 | |
| 28 | 0.02 | 6.05 | 28.01 | 7.03 | 1.01 | — | 0.48 | |
| 29 | 0.02 | 8.13 | 29.98 | 7.01 | 1.03 | — | 0.47 | |
| 30 | 0.02 | 10.08 | 29.45 | 7.12 | 1.06 | — | 0.45 | |
| AISI304 | 0.07 | 8.61 | 19.59 | 0.74 | 0.61 | — | 0.04 | |
| AISI316 | 0.08 | 11.06 | 16.97 | 2.57 | 0.52 | — | 0.03 | |
| AISI316L | 0.02 | 11.05 | 16.97 | 2.57 | 0.52 | — | 0.03 | |
| SUS M329 | 0.02 | 7.75 | 21.66 | — | 0.43 | 0.89 | 0.007 | |
| SUS329J1 | 0.06 | 5.68 | 23.05 | 1.34 | 0.34 | 0.47 | — | |
| SAF2507 | 0.03 | 7.00 | 25.00 | 4.00 | 0.80 | 1.2 | 0.30 | |
| UR52N+4 | 0.03 | 8.00 | 25.00 | 3.80 | 1.00 | 1.0 | 0.26 | Cu 1.5 |
| ZERON 100 | 0.03 | 9.00 | 26.00 | 4.00 | 1.00 | 1.0 | 0.30 | W 1.0<br>Cu 1.0 |

EXAMPLE II

Stress Corrosion Cracking Test

Specimen Nos. 1 through 12 obtained in Example 1 were tested for stress corrosion cracking. This test was carried out by a teach of constant extension rate test (CERT) according to ASTM G 36–75. For test conditions, cross-head speed was $4.41\times10^{-6}$ cm/sec and initial deformation rate was $1.35\times10^{-5}$/sec. The specimens were polished with SiC abrasive paper Nos. 120 to 600, degreased with acetone, washed with distilled water and then, dried. Final abrasion direction was rendered parallel to the rolling direction.

For measuring fracture time, Specimen Nos. 1 to 12 were immersed in respective 1L corrosion cells containing 42% $MgCl_2$ with a temperature of 154° C. maintained. As a reference, AISI 304 alloy, commercially available from Sammi Special Steel Co. Ltd, Korea, was used.

Figure 2A:
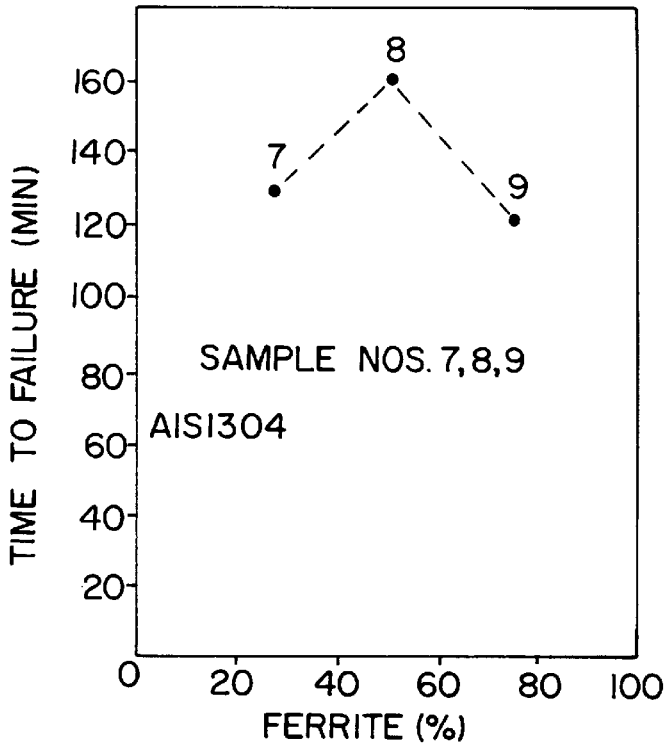
FIGS. 2A and 2B are graphs comparatively showing the results of stress corrosion cracking test of the alloy samples
Figure 2B:
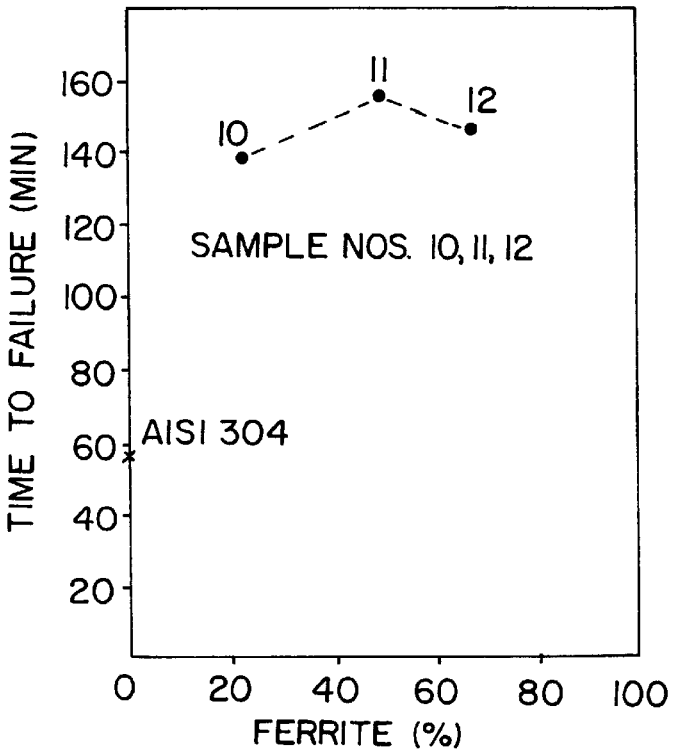

FIG. 1 shows the results of this stress corrosion cracking test for Specimen Nos. 1 to 6 and FIGS. 2A and 2B show the results for Specimen Nos. 7 to 12 and the reference, AISI 304 alloy. From these drawings, it is revealed that the alloys according to the present invention are quite superior to the reference in resistance to stress corrosion cracking.

EXAMPLE III

Pitting Test (Weight Loss Test)

Specimen Nos. 1 through 6 were subjected to a weight loss test according to ASTM G 48. Following immersion of Specimen Nos. 1 to 6 in respective 10 wt % $FeCl_3.6H_2O$ solutions for 24 hours, their corrosion rates were evaluated by weight loss. As references, AISI 316L and SUS M329, both commercially available from Sammi Special Steel Co. Ltd., Korea, were used.

Figure 3:
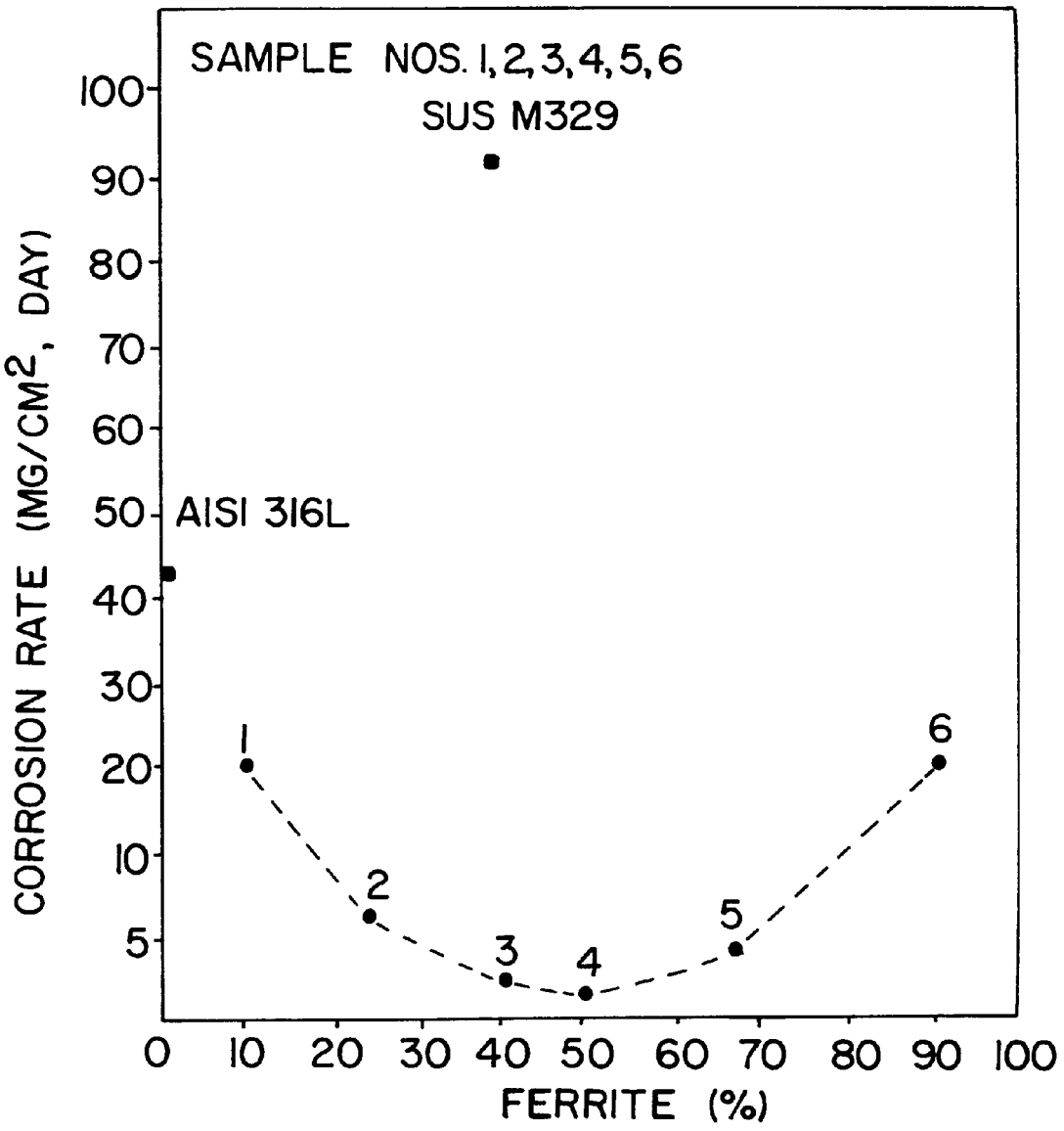
FIG. 3 is a graph comparatively showing the results of pitting test (immersion test) of the alloy samples of this invention (sample Nos. 1, 2, 3, 4, 5 and 6), AISI 316L stainless steel and SUS M329 stainless steel.

With reference to FIG. 3, there are shown the corrosion rates of the specimens with the references. As apparent from this figure, Specimen Nos. 1 to 6 are stainless steels that are even more corrosion resistant than AISI 316L alloy, and show superior corrosion resistance relative to SUS M329, a duplex phase stainless steel.

EXAMPLE IV

Pitting Test (Anodic polarization test in a test solution of 0.5N HCl+1N NaCl)

Specimen Nos. 1 through 6, 19, 20 and 22 to 27 were immersed in mixture solutions of 0.5N HCl and 1N NaCl at 50° C. Using a potentiostat, potential was scanned from corrosion potential in the anodic direction to obtain voltage-current curves. As reference alloys, AISI 316L and SUS M329, both stainless steels commercially available from Sammi Special Steel Co. Ltd., Korea, were used. The results are given as shown in Table 2 below.

Figure 4:
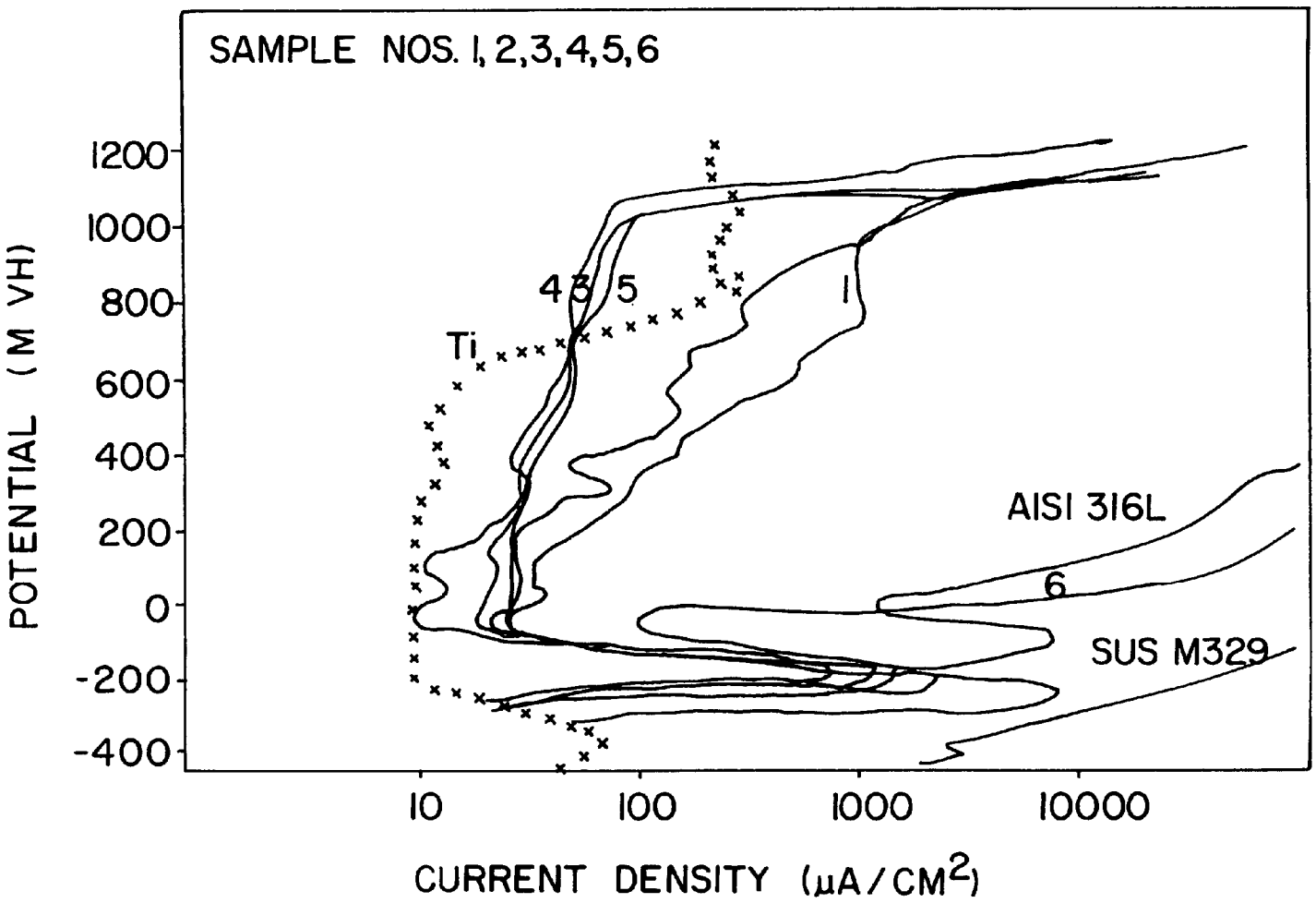
FIG. 4 is a graph comparatively showing the results of pitting test (anodic polarization test) of the alloy samples of this invention (sample Nos. 1, 2, 3, 4, 5 and 6), AISI 316L stainless steel and SUS M329 stainless steel.

From FIG. 4, it is recognized that all present alloys but No. 6 show wide passive regions. This figure also shows that, in contrast with the present alloys, the references, AISI 316L and SUS M329, show serious pitting, which demonstrates rapid corrosion as the potential is increased. An observation of the surfaces of Specimen Nos. 1 to 5 after the test revealed that there was no pits on the alloy surface. Further, the present alloys exhibit corrosion resistance comparable with that of titanium, an expensive metal.

TABLE 2

| Alloy No. | Equi. Cr/Ni | Ferrite Content % | $I_{crit}$ $\mu A/cm^2$ | Passive Region mV | Passive Current $uA/cm^2$ | Pitting |
|---|---|---|---|---|---|---|
| 1 | 23.78/22.01 | 21 | 1300 | 1000≦ | 150 | X |
| 2 | 24.20/18/08 | 33 | 1125 | 1000≦ | 80 | X |
| 3 | 25.27/16.66 | 45 | 680 | 1000≦ | 17 | X |
| 4 | 24.26/15.16 | 54 | 620 | 1000≦ | 15 | X |
| 5 | 24.53/14.14 | 75 | 870 | 1000≦ | 20 | X |
| 6 | 23.89/12.06 | 84 | 5700 | 350 | 150 | O |
| 19 | 23.00/18.80 | 50 | 673 | 1000≦ | 15 | x |
| 20 | 25.14/16.82 | 80 | 742 | 490 | 52 | OO |
| 22 | 22.86/20.98 | 41 | 660 | 1000≦ | 13 | X |
| 23 | 24.34/19.81 | 85 | 1031 | 800 | 14 | O |
| 24 | 24.03/20.47 | 79 | 1120 | 800 | 15 | O |
| 25 | 24.71/14.98 | 65 | 720 | 1000≦ | 25 | X |
| 26 | 24.61/15.25 | 51 | 640 | 1000≦ | 18 | X |
| 27 | 24.58/14.94 | 47 | 589 | 1000≦ | 19 | X |
| 28 | 31.57/21.38 | 43 | 1090 | 1000≦ | 11 | X |
| 29 | 33.55/23.20 | 49 | 850 | 1000≦ | 9.5 | X |
| 30 | 33.17/24.63 | 61 | 1200 | 1000≦ | 10 | X |
| AISI 316L | 15.33/14/68 | 0 | 6100 | 170 | — | OO |
| SUS M329 | 17.32/11.57 | 80 | 4500 | — | — | OO |

note: X: none of pitting, OO: serious pitting

EXAMPLE V

Pitting Test (Anodic polarization test in an artificial sea water test solution according to ASTM D-1141-52)

Artificial sea water was prepared according to ASTM D-1142-52, to be used for a test solution for Specimen Nos.

25 to 27 obtained in Example I. As references, AISI 304 and AISI 316, both commercially available stainless steels from Sammi Special Steel Co. Ltd., Korea, were used. Results were given as shown in Table 3 below.

TABLE 3

Pitting Resistance in Artificial Sea Water Solution according to ASTM D-1141-52

| Alloy No. | Equi. Cr/Ni | Passive Region mV | Passive Current Density uA/cm$^2$ | Pitting |
|---|---|---|---|---|
| 25 | 24.71/14.98 | 1000≦ | <10 | X |
| 26 | 24.61/15.25 | 1000≦ | <10 | X |
| 27 | 24.56/14.00 | 1000≦ | <10 | X |
| AISI 304 | 16.26/14.00 | 500 | <10 | OO |
| AISI 316 | 15.33/16.49 | 600 | <10 | OO |

note: X: none of pitting, OO: serious pitting

EXAMPLE VI

The chromium/nickel equivalents of Specimen Nos. 13 to 17 obtained in Example I were 25.96/19.28, 22.26/18.21, 26.13/21.98, 26.22/21.56, and 26.23/22.65, respectively. An anodic polarization test was carried out in a mixture solution of 0.5N HCl and 1N NaCl, in the same manner as in Example IV, so as to obtain data for corrosion resistance. The results of testing Specimen Nos. 13 to 17 and SUS 329J1, a commercially available duplex phase stainless steel, for mechanical properties and corrosion resistance are given as shown in Table 4 below.

TABLE 4

Properties of Present and Reference Alloys

| Alloy No. | Yield Str. kg/mm$^2$ | Tens. Str. kg/mm$^2$ | Elong. % | $I_{crit}$ uA/cm$^2$ | Passivity Current Region mV | Passivity Current Density $\mu$A/cm$^2$ | Pitting |
|---|---|---|---|---|---|---|---|
| 13 | 73.8 | 101.5 | 25.3 | 295 | 1010 | 11.2 | X |
| 14 | 73.2 | 98.9 | 29.2 | 3990 | 380 | 45.5 | O |
| 15 | 75.1 | 106.5 | 22.9 | 205 | 1010 | 24.2 | X |
| 16 | 76.3 | 109.2 | 28.4 | 150 | 1010 | 25.2 | X |
| 17 | 77.2 | 112.8 | 27.2 | 145 | 1010 | 9.6 | X |
| SUS 329J1 | 68.1 | 81.2 | 23.5 | 8900 | 290 | 95.5 | OO |

Note: X: none of pitting; O: pitting; OO: serious pitting

As apparent from Table 4, the present alloys are quite superior to the commercial available stainless steels in the mechanical properties and corrosion resistance to the solution containing chloride ions.

EXAMPLE VII

Aging Heat Treatment

Using Specimen Nos. 13 and 15 obtained in Example I, an effect of aging heat treatment was evaluated. The specimens were thermally treated at temperatures ranging from 700 to 950° C. in a mixture salt bath of $BaCl_2$ and NaCl. A series of tests, e.g. measurement of ferrite content, intergranular corrosion test (according to ASTM 262 practice C), pitting test (anodic polarization test in a solution of 0.5N HCl+1N NaCl at 50° C.) and mechanical test, were carried out for the heat-treated specimens. The results are given as shown in Table 5 below.

Through point count method from optical micrographs of the specimens, the ferrite contents of the specimens were obtained, showing about 15% at 850° C. and 900° C., smaller content than at any other temperature. It was revealed that the ferrite content was not largely affected by aging time (from 10 minutes to 3 hours).

The results of intergranular corrosion test say that the specimens both are corroded at the highest rate at 700° C. and at more reduced rate at higher temperatures. Reduction of the corrosion rate as temperature is increased is believed to be attributed to a fact that chromium in the matrix structure is readily rediffused into sensitization region at high temperatures.

From an observation of the surfaces of the specimens before and after the anodic polarization test, it was revealed that initiation of pitting took place at ferrite phase and its propagation does not have any preference for ferrite and austenite phases.

EXAMPLE VIII

Effect of Aging Heat Treatment

Specimen No. 18 obtained in Example I was subjected to aging heat treatment in a mixture salt bath of $CaCl_2$ and NaCl at each temperatures of 550, 650, 750, 850 and 950° C. for a period of 10, 30, 60 and 180 minutes. For this specimen, an observation of structure, a measurement of ferrite content and an intergranular corrosion test according to ASTM A262 PRACTICE C were performed. With respect to intergranular corrosion rate, an immersion test was carried out according to ASTM G48, with the same anodic polarization test as in Example IV followed at 50° C. in a mixture solution of 0.5N HCl and 1N NaCl. The results are given as shown in Table 6 below.

EXAMPLE IX

Effect of Aging Heat Treatment

Specimen Nos. 19, 20 and 22 to 24 obtained in Example I were subjected to aging heat treatment. This treatment was carried out in a mixture salt bath of $CaCl_2$ and NaCl at each temperatures of 550, 650, 750, 850 and 950° C. for a period of 10, 30 and 180 minutes. Likewise, there were observations of structure, measurements of ferrite content and intergranular corrosion tests. Further, pitting tests and mechanical tests were carried out. The results are given as shown in Tables 5 and 6.

TABLE 5

Effect of Aging Heat Treatment

| Alloy No. | [1]Ferrite Content % | [2]Aging Heat Treatment Temp. ° C. | Intergranular Corrosion Rate mg/m$^2$hr | [3]Pitting Potential mV(SHE) |
|---|---|---|---|---|
| 13 | 35 | 700 | 4,250 | no pitting |
| | | 750 | 320 | no pitting |
| | | 800 | 290 | 870 |
| | | 850 | 250 | no pitting |
| | | 900 | 112 | no pitting |
| 15 | 40 | 700 | 3,043 | no pitting |
| | | 750 | 152 | 789 |
| | | 800 | 146 | no pitting |
| | | 850 | 144 | no pitting |
| | | 950 | 110 | no pitting |

TABLE 5-continued

Effect of Aging Heat Treatment

| Alloy No. | [1]Ferrite Content % | [2]Aging Heat Treatment Temp. ° C. | Intergranular Corrosion Rate mg/m²hr | [3]Pitting Potential mV(SHE) |
|---|---|---|---|---|
| 22 | 41 | 550 | 1,200 | no pitting |
| | | 650 | 1,899 | 879 |
| | | 750 | 3,100 | 650 |
| | | 850 | 670 | no pitting |
| | | 900 | 125 | no pitting |
| 23 | 85 | 550 | 765 | 380 |
| | | 650 | 812 | 376 |
| | | 750 | 987 | 350 |
| | | 850 | 234 | 378 |
| | | 950 | 113 | 390 |
| 24 | 79 | 550 | 798 | 346 |
| | | 650 | 805 | 312 |
| | | 750 | 1,012 | 298 |
| | | 850 | 351 | 364 |
| | | 950 | 120 | 387 |

TABLE 6

Effect of Aging Heat Treatment

| Alloy No. | [1]Ferrite Content % | [2]Aging Heat Treatment Temp. ° C. | Intergranular Corr. Rate mg/m²hr | [3]Pitting Potential mV (SHE) | Pit Corr. Rate mdd | Passive Current Density $\mu A/cm^2$ |
|---|---|---|---|---|---|---|
| 18 | 80 | 550 | 650 | None | 42 | 9 |
| | | 650 | 1,234 | 912 | 125 | 15 |
| | | 750 | 1,100 | 680 | 150 | 18 |
| | | 850 | 213 | None | 54 | 10 |
| | | 950 | 108 | None | 57 | 9 |
| 19 | 50 | in anneal | — | None | — | 3 |
| | | 550 | — | None | — | 6 |
| | | 650 | — | None | — | 7 |
| | | 750 | — | 842 | — | 6 |
| | | 850 | — | None | — | 10 |
| | | 950 | — | None | — | 5 |
| 20 | 80 | in anneal | — | 834 | — | 5 |
| | | 550 | — | 459 | — | 25 |
| | | 650 | — | 478 | — | 18 |
| | | 750 | — | 513 | — | 13 |
| | | 850 | — | 543 | — | 11 |
| | | 950 | — | 650 | — | 8 |

note
[1]when annealing treatment
[2]treatment for 10 minutes
[3]in anodic polarization test, none: no pitting generation

EXAMPLE X

Effect of Cold Working

With main instance of electrolytic iron, chromium, nickel, molybdenum, Fe—Si, Fe—Cr—N, all commercially pure quality grade, 12 kg of alloy Specimen No. 21 was prepared according to the composition as indicated in Table 1, under a nitrogen atmosphere in a high frequency induction furnace. At the moment parts containing pores were detected by radiography were removed.

After the resulting ingot were subjected to soaking at 1,200° C. for 30 min., it was hot rolled into a thickness of 3 mm. Scale which was produced on the surface owing to the hot rolling was removed by pickling it in a mixture solution of nitric acid and hydrofluoric acid with a temperature of 66° C. maintained.

Thereafter, it was thermally treated at 1,150° C. for 10 min. and then, quenched at room temperature to give a cold working rate of 0%, 10%, 30% and 60%, on the basis of thickness reduction. Following this, it was subjected to recrystallization at 1,000° C. for 5 min. The equivalent value of Cr/Ni in the present alloy was 22.76/24.90.

An aging heat treatment was carried out in which the prepared specimen was immersed in a mixture salt bath of $CaCl_2$ and NaCl at each temperatures of 650, 750, 850 and 950° C. for a period of 10, 30 and 180 min. and cooled in water at room temperature.

An intergranular corrosion test (according to ASTM A262 PRACTICE C) and an anodic polarization test (50° C., 0.5N HCl+1N NaCl, scanning rate 20 mV/min) were performed. As for intergranular corrosion rate according to aging temperature, it was the fastest at 750° C., whereas the slowest at 950° C.

An X-ray diffraction analysis revealed that a sigma phase was detected in the specimens aging-treated at 850° C. or 950° C. This sigma phase was produced owing to the decomposition of ferrite upon aging heat treatment and is believed to decrease a phase boundary, a priority place of producing crystal nucleus of carbide, contributing to a reduction of corrosion rate.

In case of performing both cold working and heat treatment, large working rate brought about more reduction in grain size. As for corrosion rate according to grain size, it was the largest for the largest grain size which resulted from the heat treatment at a temperature of 650° C. or 750° C. On the other hand, as the grain size becomes smaller, the corrosion rate became reduced. This says that the degree of sensitization increases with large coarse size.

Where aging heat treatment was not executed, in contrast, the corrosion rate became increased with fine grain size resulting from thermo-mechanical treatment in anodic polarization test. This is attributed to a fact that the initiation point of pitting becomes relatively abundant as the grain size is smaller. Such thermo mechanical treatment specimens were subjected to aging heat treatment and then, to anodic polarization test. Of the resulting specimens under conditions of 650° C. and 30 min., one with the smallest grain size was of the best anodic polarization resistance.

EXAMPLE XI

In this example, Specimen Nos. 2 through 5 were tested for the effect of cold working. The annealed specimens of Example I were cold rolled in each rates of 0, 10, 30, 40, 50 and 60%, followed by carrying out stress corrosion cracking test (42% $MgCl_2$, ASTM STANDARD G 36–75) and mechanical test.

With respect to the effect of cold working on stress corrosion cracking resistance, Specimen No. 2, which was rich in austenite, became high in resistance as the cold working rate was more increased. On the other hand, the other specimens, relatively rich in ferrite, became low in resistance with increased cold working rate. This tendency is believed to be attributed to a fact that the external stresses all are exhausted to work harden the soft austenite and the austenite thus work-hardened prevents movement of dislocation, thereby inhibiting the propagation of crack. However, if ferrite is abundant, the external stresses cause an internal deformation in the ferrite, which forces into the propagation of crack.

After Specimen No. 4 was cold worked, mechanical properties were measured. Under the working rate of 0%, it showed a yield strength of 50 kg/mm², a tensile strength of 75 kg/mm$^2$ and a Vickers hardness of 280. Under the working rate of 60%, these mechanical properties were improved, e.g. a yield strength of 100 kg/mm$^2$, a tensile strength of 120 kg/mm$^2$ and a Cickers hardness of 395.

EXAMPLE XII

Making of Stainless Steel

With substance of electrolytic iron, chromium, nickel, molybdenum, Fe—Si, Fe—Cr—N, all commercially pure grade, 30 kg of each of alloy specimens was prepared according to the compositions as indicated in Table 7, in a high frequency vacuum induction furnace.

After the resulting ingots were subjected to soaking at 1,250° C. for 120 min., they were hot rolled into a thickness of 4 mm. Scale which was produced on the surface owing to the hot rolling was removed by pickling them in a mixture solution of nitric acid and hydrofluoric acid with a temperature of 66° C. maintained. Thereafter, they were cold rolled into a thickness of 1 mm, annealed at a temperature of 1,125° C. for 5 min. and cooled in water. Likewise, the scale produced on the surface due to annealing was removed.

TABLE 7

Chemical Composition of the Present Alloys
Unit: wt %

| Alloy No. | C | Ni | Cr | Mo | Si | Mn | N | Others | | |
|---|---|---|---|---|---|---|---|---|---|---|
| 31 | 0.04 | 7.90 | 23.20 | 5.70 | 0.60 | 0.03 | 0.33 | Ti 0.65 | | |
| 32 | 0.03 | 5.50 | 25.70 | 4.30 | 0.60 | 0.02 | 0.36 | | | |
| 33 | 0.03 | 5.60 | 26.30 | 5.00 | 0.60 | 0.02 | 0.43 | | | |
| 34 | 0.03 | 5.20 | 21.00 | 6.80 | 1.00 | 1.90 | 0.27 | Ti 1.5 | W 2.5 | |
| 35 | 0.04 | 5.10 | 22.30 | 4.60 | 1.00 | 1.90 | 0.27 | Ti 1.4 | W 2.6 | |
| 36 | 0.04 | 3.80 | 24.80 | 4.10 | 1.00 | 3.10 | 0.35 | Ti 1.7 | W 2.6 | |
| 37 | 0.02 | 7.10 | 19.90 | 6.60 | 0.90 | 0.06 | 0.21 | Ti 0.71 | | |
| 38 | 0.03 | 7.00 | 23.00 | 5.60 | 0.5O | 0.05 | 0.33 | B 0.001 | Ti 0.72 | Al 0.001 |
| 39 | 0.03 | 7.00 | 26.00 | 5.10 | 0.50 | 0.50 | 0.41 | B 0.001 | Ti 0.72 | W 0.7 |
| 40 | 0.03 | 4.58 | 30.55 | 2.50 | 0.50 | 0.5O | 0.51 | B 0.005 | Ti 0.75 | Al 0.012 |
| 41 | 0.03 | 7.90 | 33.70 | 3.10 | 0.80 | 0.60 | 0.44 | B 0.001 | Ca 0.005 | |
| 42 | 0.03 | 8.20 | 34.90 | 2.50 | 0.60 | 0.50 | 0.49 | B 0.001 | Ca 0.002 | |
| | | | | | | | | V 0.5 | Mg 0.003 | |
| 43 | 0.03 | 6.20 | 20.50 | 5.40 | 0.61 | 0.41 | 0.26 | Cu 1.9 | | |
| 44 | 0.02 | 7.40 | 23.50 | 4.30 | 0.42 | 0.53 | 0.34 | Cu 0.72 | | |
| 45 | 0.03 | 8.50 | 25.90 | 5.00 | 0.53 | 0.56 | 0.36 | Cu 0.65 | | |
| 46 | 0.03 | 7.50 | 23.10 | 5.60 | 0.61 | 0.64 | 0.32 | Cu 0.71 | W 1.2 | |
| 47 | 0.03 | 7.00 | 23.30 | 5.50 | 0.50 | 0.62 | 0.33 | Cu 0.85 | Ti 0.75 | |

When compared with specimens obtained in Example I, Specimen Nos. 38 through 42 each which contains boron, aluminum, calcium, magnesium or combinations thereof shows improved hot workability. That is to say, there was a remarkable reduction in edge crack that was used to appearing at the opposite edges of hot plate.

EXAMPLE XIII

Comparison of Corrosion Resistance

Specimen Nos. 31 and 37 obtained in Example XII were immersed in a 6% $FeCl_3$ solution and separately, a mixture solution of 7% $H_2SO_4$, 3% HCl, 1% $FeCl_3$ and 1% $CuCl_2$, in order to measure their critical pitting temperatures. For this, corrosion rates were calculated from measurements of the weight loss after immersing them in the solutions for 24 hours at a temperature interval of 50° C. The results are given as shown in Table 8 below.

Figure 5:
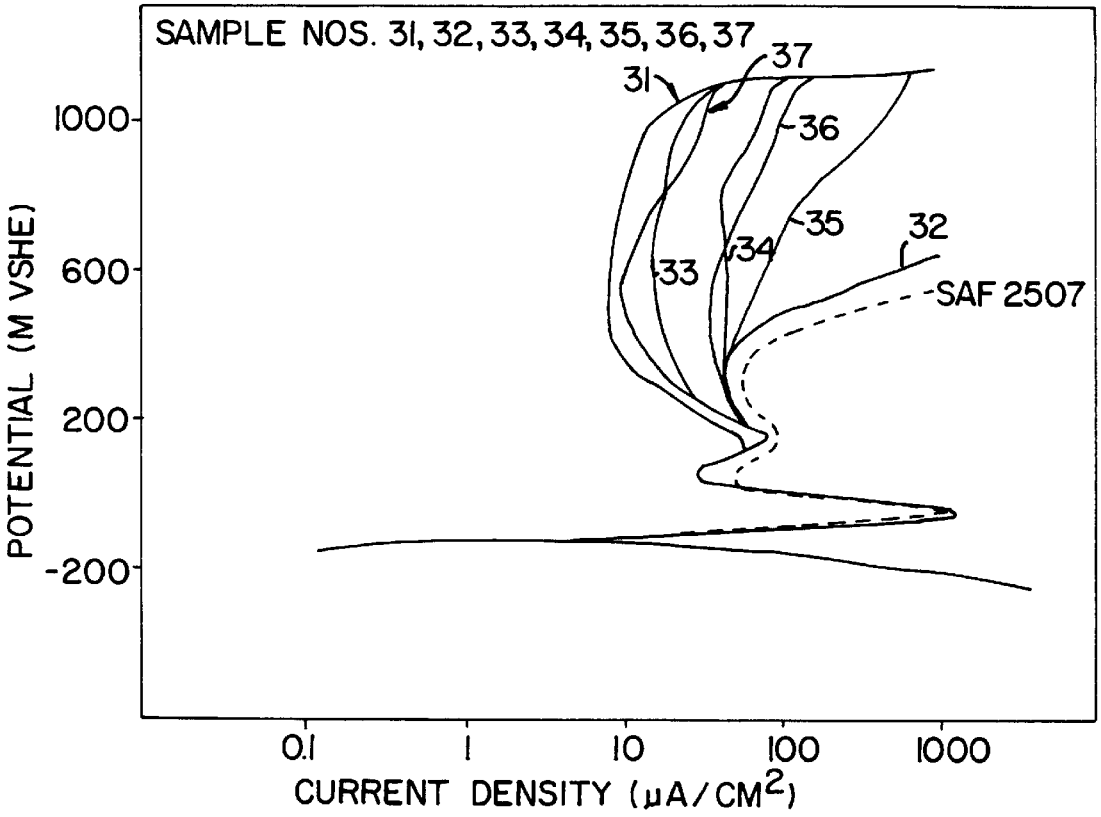
FIG. 5 is a graph comparatively showing the results of pitting test (anodic polarization test: 70° C., 0.5N HCl+1N NaCl) of the alloy samples of this invention (sample Nos. 31, 32, 33, 34, 35, 36 and 37) and SAF 2507 stainless steel.
Figure 6:
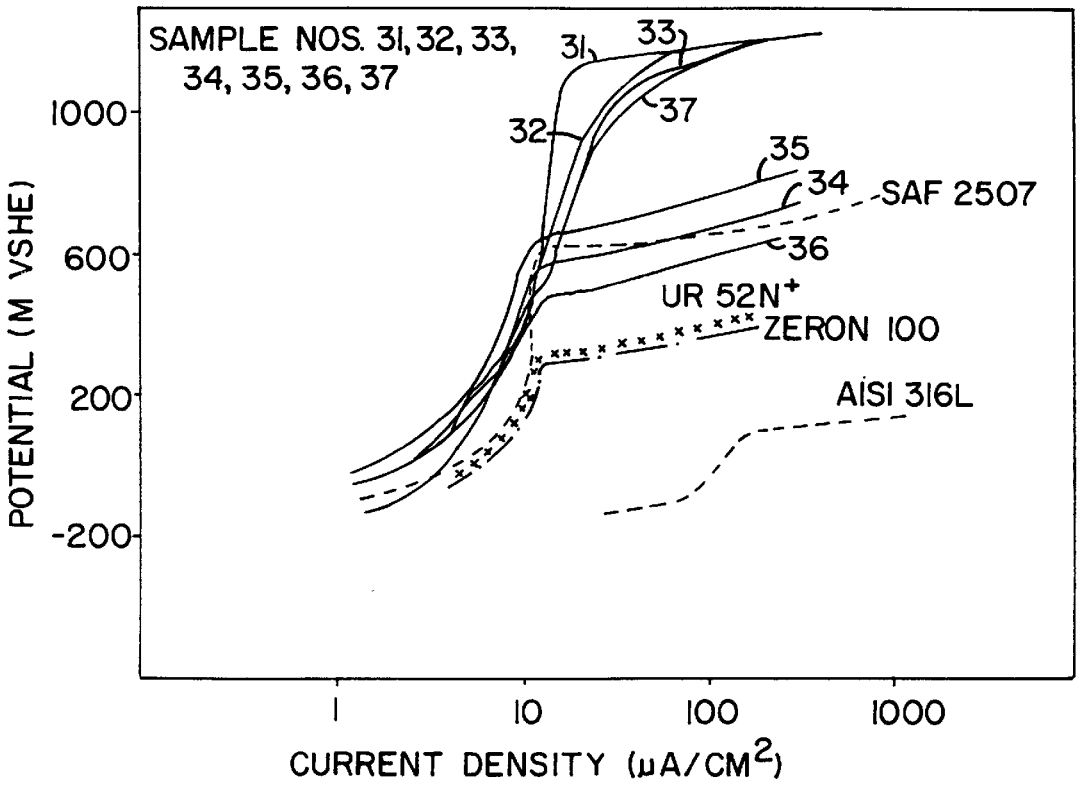
FIG. 6 is a graph comparatively showing the results of pitting test (anodic polarization test: 80° C., 22% NaCl) of the alloy samples of this invention (sample Nos. 31, 32, 33, 34, 35, 36 and 37), AISI 316L stainless steel (Sammi Special Steel Co. Ltd., Korea), SAF 2507 stainless steel (Sandvik Steel Co., Sweden), Zeron 100 stainless steel (Weir Co., U.K.) and UR52N+ stainless steel (Creusot-Loire Industrie Co., France)

For measurement of anodic polarization resistance, the specimens were immersed in a mixture solution of 0.5N HCl and 1N NaCl at a temperature of 70° C. maintained and separately, in a 22% NaCl solution at a temperature of 80° C. maintained. Using a potentiostat, potential was scanned from the corrosion potential in the anodic direction to obtain voltage-current curves. As a reference, SAF2507, a commercially available stainless steel, were used. The Results are given as shown in Table 8 below. FIGS. 5 and 6 show the superior corrosion resistance of the present alloys.

TABLE 8

Critical Pitting Temperature and Anodia Polarization Resistance

| Alloy No. | Critical Pitting Temp. ° C. 6% $FeCl_3$ | [1]Mixed Solution | Anodic Polarization Resist. 70° C. 0.5N HCl + 1N NaCl | 80° C. 22% NaCl |
|---|---|---|---|---|
| 31 | ≧bp. | 95–90 | no pitting | |
| 37 | 95–90 | 85–80 | no pitting | |
| SAF2507 | 85–80 | 65–60 | serious pitting | |

[1]7% $H_2SO_4$ + 3% HCl + 1% $FeCl_3$ + 1% $CuCl_2$

EXAMPLE XIV

Effect of Aging Heat Treatment

In order to evaluate the effect of titanium on aging heat treatment, Specimen Nos. 31 to 33 and 37 were subjected to aging heat treatment at 800° C. for 1 hour and then, to intergranular corrosion test (Huey Test). Corrosion rates of the specimens were 131, 667, 635 and 159 mg/m$^2$hr, respectively.

Figure 7A:
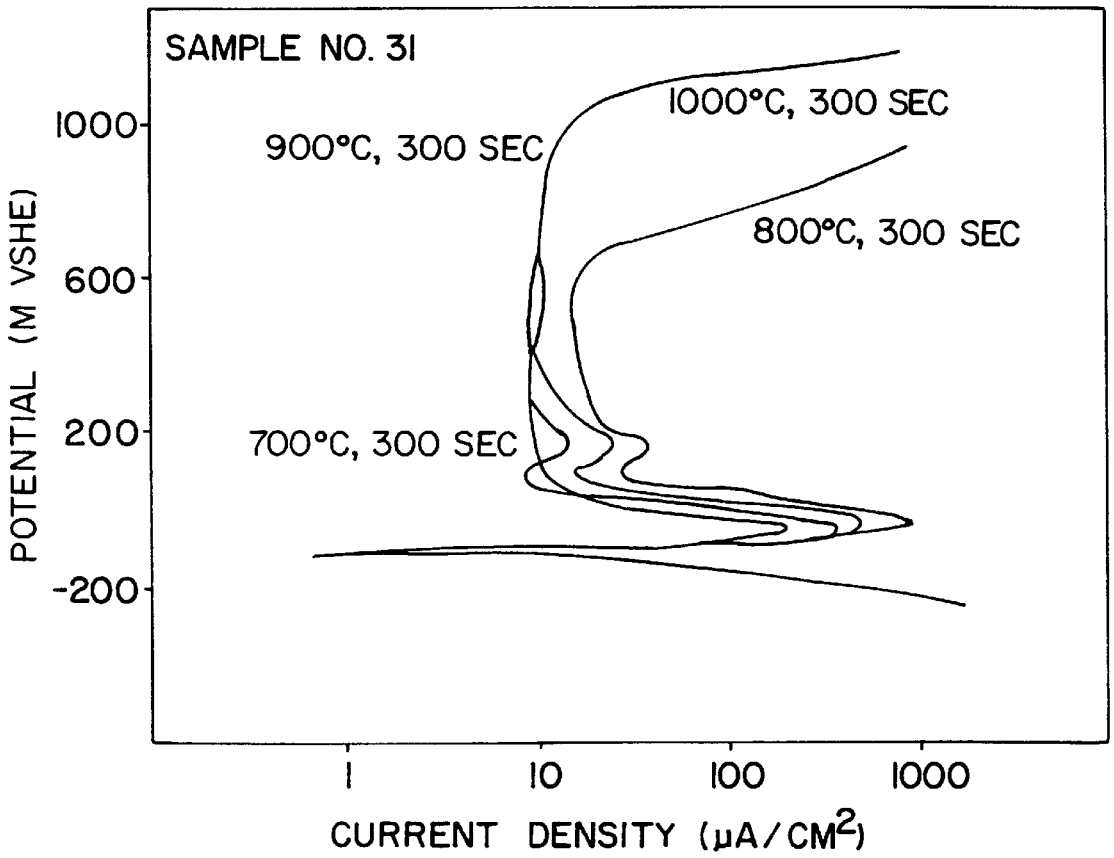
FIGS. 7A and 7B are graphs showing the results of pitting test (anodic polarization test: 50° C., 0.5N HCl+1N NaCl) of alloy samples 31 and 37 of this invention in accordance with aging heat treatments respectively.
Figure 7B:
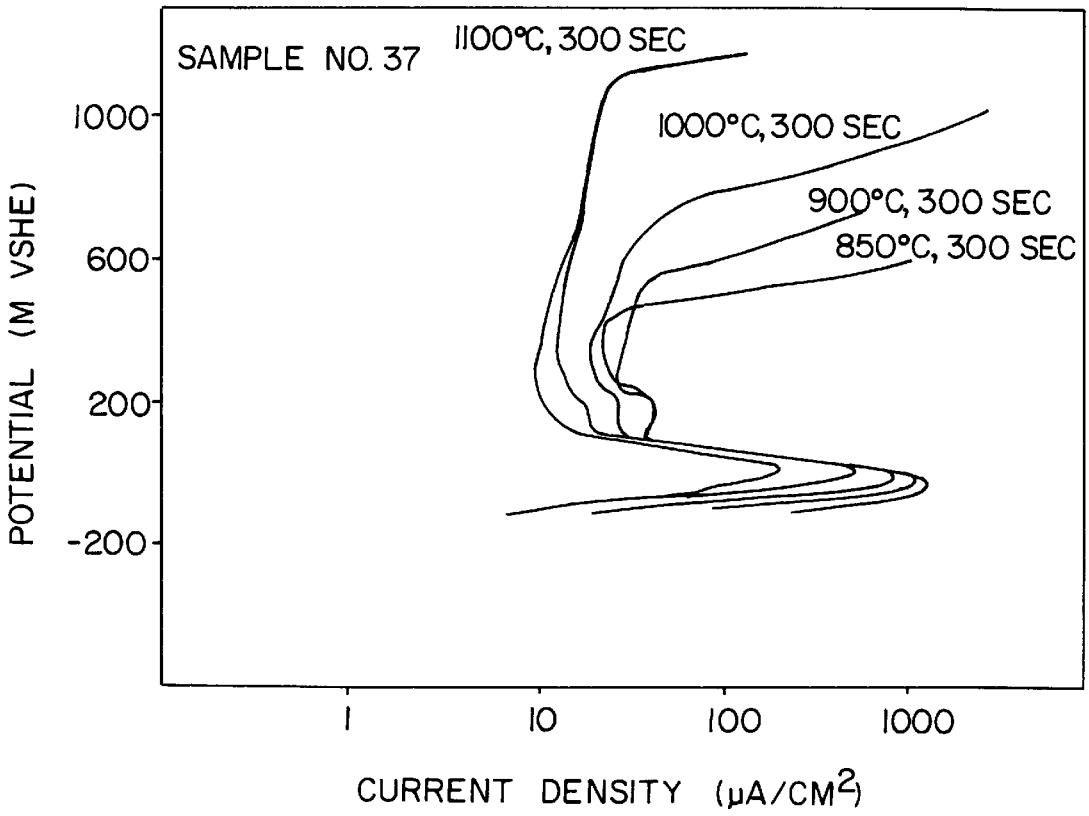
Figure 8:
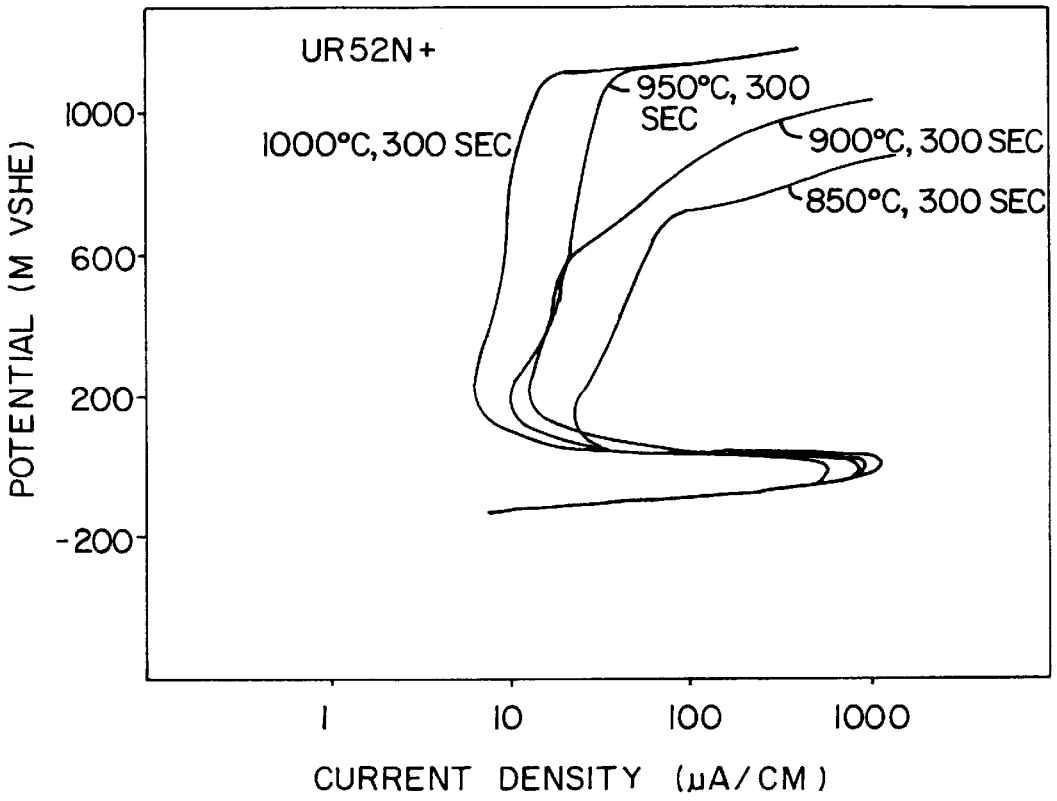
FIG. 8 is a graph showing the results of pitting test (anodic polarization test: 50° C., 0.5N HCl+1N NaCl) of UR52N+ stainless steel (Creusot-Loire Industrie Co., France) in accordance with aging heat treatments.

It was revealed that Specimen No. 31 which contained an appropriate amount of titanium was superior to Specimen Nos. 32 and 33, devoid of titanium, in corrosion resistance even after aging heat treatment. FIGS. 7 and 8 show the corrosion resistance of the present alloys and a reference after heat treatment.

EXAMPLE XV

Specimen Nos. 37 and 43 through 47 obtained in Example XII were immersed in 10% sulfuric acid solution at 80° C. for 24 hours and separately, in 10% hydrochloric acid solution at 25° C. for 24 hours, to measure corrosion rates thereof. The results are given as shown in Table 9 below. As apparent from Table 9, addition of copper allows the alloy to be improved in corrosion resistance to acid.

TABLE 9

Effect of Cu Addition

| Alloy No. | Corrosion Rate (80° C., 10% $H_2SO_4$, mdd) | Corrosion Rate (25° C., 10% HCl, mdd) |
|---|---|---|
| 37 | 139 | 959 |
| 43 | 71 | 932 |
| 44 | 56 | 899 |
| 45 | 55 | 901 |
| 46 | 47 | 786 |
| 47 | 49 | 790 |
| SAF 2507 | 84 | 3,362 |
| UR52N+ | 115 | 2,004 |
| Zeron 100 | 403 | 2,546 |

Other features, advantages and embodiments of the present invention disclosed herein will be readily apparent to those exercising ordinary skill after reading the foregoing disclosures. In this regard, while specific embodiments of the invention have been described in considerable detail, variations and modifications of these embodiments can be effected without departing from the spirit and scope of the invention as described and claimed.

What is claimed is:

1. A corrosion resistant duplex phase stainless steel consisting essentially of:

20–30 wt % chromium, 3–8.5 wt % nickel, 5.1–8 wt % molybdenum, 0.20 wt % or less carbon, 0.5–2.0 wt % silicon, 3.5 wt % or less manganese, 0.25–0.5 wt % nitrogen and the balance iron.

2. The stainless steel according to claim 1, further comprising:

at least one element selected from the group of 1.5 wt % or less titanium, 3 wt % or less tungsten, 2 wt % or less copper, and 2 wt % or less vanadium.

3. The stainless steel according to claim 1, further comprising:

at least one element selected from the group of 0.001–0.01 wt % boron, 0.001–0.1 wt % magnesium, 0.001–0.1 wt % calcium, and 0.001–0.2 wt % aluminum.

4. The stainless steel according to claim 2, further comprising:

at least one element selected from the group of 0.001–0.01 wt % boron, 0.001–0.1 wt % magnesium, 0.001–0.1 wt % calcium, and 0.001–0.2 wt % aluminum.

* * * * *